US008220671B2

(12) United States Patent
Gundrum et al.

(10) Patent No.: US 8,220,671 B2
(45) Date of Patent: Jul. 17, 2012

(54) LUBRICANT DISPENSER WITH NOZZLE

(75) Inventors: Daniel Gundrum, Slinger, WI (US); Nicholas Scherer, Hartford, WI (US)

(73) Assignee: Trico Corporation, Pewaukee, WI (US)

( * ) Notice: Subject to any disclaimer, the term of this patent is extended or adjusted under 35 U.S.C. 154(b) by 1050 days.

(21) Appl. No.: 12/156,733

(22) Filed: Jun. 3, 2008

(65) Prior Publication Data

US 2009/0230158 A1 Sep. 17, 2009

Related U.S. Application Data

(63) Continuation-in-part of application No. 29/301,659, filed on Mar. 12, 2008, now Pat. No. Des. 589,807, and a continuation-in-part of application No. 29/301,660, filed on Mar. 12, 2008, now Pat. No. Des. 589,808, and a continuation-in-part of application No. 29/301,661, filed on Mar. 12, 2008, now Pat. No. Des. 589,809.

(51) Int. Cl.
*B67D 3/00* (2006.01)
*B67D 7/06* (2010.01)

(52) U.S. Cl. ..... 222/507; 222/521; 222/524; 222/525

(58) Field of Classification Search ..... 222/524, 222/550, 525, 548, 51–521
See application file for complete search history.

(56) References Cited

U.S. PATENT DOCUMENTS

| | | | | |
|---|---|---|---|---|
| 126,624 | A | 5/1872 | Coffee | |
| 539,117 | A | 5/1895 | Busch | |
| 779,357 | A | 1/1905 | Gardner | |
| 805,645 | A | 11/1905 | Guillott | |
| 992,503 | A | 5/1911 | Howard | |
| 1,113,276 | A | 10/1914 | Woodmansee | |
| 1,571,495 | A | 2/1926 | Smith | |
| 1,600,262 | A | 9/1926 | Wickham | |
| 1,610,283 | A | 12/1926 | Hill | |
| 1,687,395 | A | 10/1928 | Shew | |
| 1,688,279 | A | 10/1928 | Locke | |
| 1,864,195 | A | 6/1932 | Hall | |
| 2,127,040 | A * | 8/1938 | Mann | 222/507 |

(Continued)

FOREIGN PATENT DOCUMENTS

| | | |
|---|---|---|
| CA | 2291763 | 7/2002 |

(Continued)

OTHER PUBLICATIONS

Measuring Moisture in Liquids: A New Method, *Sensors*, Dec. 1996 pp. 42-47.

(Continued)

*Primary Examiner* — Kevin P Shaver
*Assistant Examiner* — Melvin Cartagena
(74) *Attorney, Agent, or Firm* — Ryan Kromholz & Manion, S.C.

(57) ABSTRACT

An apparatus according to the present invention provides a fluid pour spout including a plunger having a variable position for controlling the flow of fluid therethrough. Also provided is a fluid container having a fluid pour spout including a plunger having a variable position for controlling the flow of fluid therethrough, the spout being at least partially integrally formed with the container or removably coupled thereto. A further apparatus according to the present invention is a lid including a fluid pour spout including a plunger having a variable position for controlling the flow of fluid therethrough, the lid being removably coupleable to a fluid container.

4 Claims, 6 Drawing Sheets

U.S. PATENT DOCUMENTS 2,227,646 A 1/1941 Hillman
2,335,557 A 11/1943 Winther
2,340,455 A 2/1944 Davis
2,376,623 A 5/1945 Romberg
2,397,597 A 4/1946 Dunkle
2,439,709 A 4/1948 Ashbury
2,589,081 A 3/1952 Hertz
2,608,993 A 9/1952 Andrews
2,703,628 A 3/1955 Pompeo et al.
2,774,621 A 12/1956 Kilbourne, Jr.
2,930,432 A 3/1960 Engstrom
2,950,943 A 8/1960 Forrest
2,995,213 A 8/1961 Gross
3,123,095 A 3/1964 Kohler
3,193,990 A 7/1965 Smith
3,233,173 A 2/1966 Lees et al.
D205,166 S 6/1966 Price
3,323,291 A 6/1967 Kern
3,338,262 A 8/1967 Chopelin
3,447,562 A 6/1969 Hoffman
D217,665 S 5/1970 Self
D217,666 S 5/1970 Self
D217,667 S 5/1970 Self
3,952,566 A 4/1976 Jacobson
4,018,579 A 4/1977 Hofmann
4,047,814 A 9/1977 Westcott
4,058,766 A 11/1977 Vegel et al.
4,064,455 A 12/1977 Hopkins et al.
4,105,092 A 8/1978 Zeidler et al.
4,227,419 A 10/1980 Park
4,312,424 A 1/1982 Taylor et al.
4,345,668 A 8/1982 Gaunt
4,423,371 A 12/1983 Senturia et al.
4,445,168 A 4/1984 Petryszyn
4,466,508 A 8/1984 Busch
4,503,383 A 3/1985 Agar
D279,549 S 7/1985 Elmburg
4,527,661 A 7/1985 Johnstone et al.
4,591,024 A 5/1986 Erickson
4,629,334 A 12/1986 Hochstein
4,646,070 A 2/1987 Yashuhara
4,681,189 A 7/1987 Krisiloff
4,689,553 A 8/1987 Haddox
4,733,556 A 3/1988 Meitzler et al.
4,735,286 A 4/1988 Miki et al.
4,738,336 A 4/1988 Smith et al.
4,990,057 A 2/1991 Rollins
5,004,127 A * 4/1991 Morel ..... 222/521
5,025,222 A 6/1991 Scott et al.
5,039,425 A 8/1991 Caris et al.
5,045,798 A 9/1991 Hendrick
5,060,760 A 10/1991 Long et al.
5,071,527 A 12/1991 Kauffman
5,072,190 A 12/1991 Martin
5,080,195 A 1/1992 Mizumoto et al.
5,101,936 A 4/1992 Paredes et al.
5,103,181 A 4/1992 Gaisford et al.
5,125,480 A 6/1992 Gregory et al.
5,135,140 A * 8/1992 Maguire et al. ..... 222/521
D333,177 S 2/1993 Poirier
5,196,898 A 3/1993 Tamura et al.
5,197,569 A 3/1993 Roessler et al.
5,200,027 A 4/1993 Lee et al.
5,203,680 A 4/1993 Waldrop
D336,509 S 6/1993 Safford et al.
D336,679 S 6/1993 Safford et al.
5,224,051 A 6/1993 Johnson
D338,158 S 8/1993 Poirier
5,249,455 A 10/1993 Cox
5,260,665 A 11/1993 Goldberg et al.
5,262,732 A 11/1993 Dickert et al.
5,269,175 A 12/1993 Chmiel et al.
5,271,528 A 12/1993 Chien
5,273,134 A 12/1993 Hegemier et al.
5,274,335 A 12/1993 Wang et al.
5,314,613 A 5/1994 Russo
5,317,252 A 5/1994 Kranbuehl
5,318,152 A 6/1994 Ehlert
5,328,275 A 7/1994 Winn et al.
5,330,636 A 7/1994 Reichert
5,332,064 A 7/1994 Liu
5,334,941 A 8/1994 King
5,381,874 A 1/1995 Hadank et al.
5,382,942 A 1/1995 Raffa et al.
D358,097 S 5/1995 Leibowitz
D358,548 S 5/1995 Platte
5,457,396 A 10/1995 Mori et al.
5,499,902 A 3/1996 Rockwood
5,504,573 A 4/1996 Cheiky-Zelina
5,521,515 A 5/1996 Campbell
5,540,086 A 7/1996 Park et al.
5,542,499 A 8/1996 Westermeyer
5,548,217 A 8/1996 Gibson et al.
5,568,842 A 10/1996 Otani
5,596,266 A 1/1997 Mori et al.
5,604,441 A 2/1997 Freese
5,614,830 A 3/1997 Dickert et al.
5,634,531 A 6/1997 Graf et al.
5,647,735 A 7/1997 Rockwood
5,656,767 A 8/1997 Garvey, III et al.
5,671,825 A 9/1997 Wong et al.
5,674,401 A 10/1997 Dickert et al.
5,702,592 A 12/1997 Suri et al.
5,754,055 A 5/1998 McAdoo
5,779,005 A 7/1998 Jones, Jr. et al.
5,789,665 A 8/1998 Voelker et al.
5,806,630 A 9/1998 Bernal
5,816,212 A 10/1998 Lindquist et al.
5,824,889 A 10/1998 Park et al.
5,826,986 A 10/1998 Adkins et al.
5,858,070 A 1/1999 Halm et al.
5,878,842 A 3/1999 Rake
5,884,802 A 3/1999 Leibowitz
6,028,433 A 2/2000 Cheiky-Zelina et al.
6,077,330 A 6/2000 Sabelstrom
6,113,676 A 9/2000 Kumpulainen
6,192,025 B1 2/2001 Chen
6,196,522 B1 * 3/2001 Yuen et al. ..... 251/149.5
6,204,656 B1 3/2001 Cheiky-Zelina et al.
6,223,589 B1 5/2001 Dickert et al.
6,250,152 B1 6/2001 Klein et al.
6,253,601 B1 7/2001 Wang et al.
6,273,031 B1 8/2001 Verdegan et al.
6,277,173 B1 8/2001 Sadakata et al.
6,278,282 B1 8/2001 Marszalek
6,364,176 B1 * 4/2002 Kilian ..... 222/468
6,368,411 B2 4/2002 Roberson, Jr. et al.
6,443,006 B1 9/2002 Degrave
6,447,573 B1 9/2002 Rake
6,449,580 B1 9/2002 Bardetsky et al.
6,459,995 B1 10/2002 Collister
6,460,656 B1 10/2002 Jones, Jr. et al.
6,509,749 B1 1/2003 Buelna et al.
6,513,368 B2 2/2003 Bondarowicz et al.
6,519,034 B1 2/2003 Engler et al.
6,535,001 B1 3/2003 Wang
6,551,055 B2 4/2003 Rockwood
6,553,812 B2 4/2003 Park et al.
6,557,396 B2 5/2003 Ismail et al.
6,564,126 B1 5/2003 Lin et al.
6,568,919 B1 5/2003 Fletcher et al.
D485,189 S 1/2004 Montalbano et al.
6,851,676 B2 2/2005 Martins et al.
6,932,856 B2 8/2005 Rake
7,017,712 B1 3/2006 Rake et al.
D527,639 S 9/2006 Voss et al.
D528,425 S 9/2006 Van Dorin et al.
7,140,468 B2 11/2006 Rake et al.
D573,885 S 7/2008 Considine et al.
D589,597 S 3/2009 Bloch et al.
D589,807 S 4/2009 Gundrum et al.
D589,808 S 4/2009 Gundrum et al.
D589,809 S 4/2009 Gundrum et al.
7,541,004 B2 6/2009 Niksa et al.

FOREIGN PATENT DOCUMENTS

| | | |
|---|---|---|
| CA | 2289726 | 3/2003 |
| CA | 122622 | 4/2009 |
| CA | 127725 | 5/2009 |
| CA | 127726 | 5/2009 |
| CA | 1271724 | 5/2009 |
| DE | 37325 | 3/1968 |
| GB | 121092 | 12/1918 |
| JP | 2-308916 | 12/1990 |
| JP | 411132304 | 5/1999 |

OTHER PUBLICATIONS

Sensor Mediated in Situ Measurement of Moisture in Organic Liquids, Phys-Chem Scientific Corp. sales literature, date unknown.
"Hydraulic and Lubrication Systems Solutions: Water Sensor—An Essential tool for fluid condition monitoring" Pall Corporation sales literature, date unknown.
Environmental Solutions for the Military: Pall Portable Fluid Purifier, not dated; Pall Corporation web site address: www.pall.com/environ/miltary/solutions/products/purifier.html.
Pall Water Sendor: An essential tool for fluid condition monitoring; Pall Corporation sales literature, date unknown.
"Advancement of PREDICT/DLI Industrial Sensors", M.A. Cheiky-Zelina, R.W. Brown and D.E. Schuele, Department of Physics, Case Western Reserve University, Mar. 1997.
Filtration Products, Solutions for Tomorrow's Challenges, Trico sales literature, 7 pages, date unknown.
Mobile Filtration System, Oil Service Products sales literature, 1 page, date unknown.
Mobile Filtration Systems, Schroeder Industries LLC, 2 pages, date unknown.
International Search Report, dated Jan. 20, 1999 for PCT/US98/09039, International Filing Date May 8, 1998.
Iotech Catalog, p. 65, Jan. 1995.
"Model 958PF On-Line Ferrograph", *Foxboro Analytical*, (no month available) 1980, 4 pgs.
958F Series On-Line Ferrograph Installation and Operation, The Foxboro Company, (no month available) 1980, 6 pgs.
"Journal Reprints", The British Institute of Non-Destructive Testing, M.H. Jones and A.R. Massoudi, Insight, vol. 37 No. 8, Aug. 1995, pp. 606-610.
"Basics of Measuring the Dielectric Properties of Materials", Hewlett Packard, (no month available) 1992, No. 1217-1.
"The Nist 60-Millimeter Diameter Cylindrical Cavity Resonator: Performance Evaluation for Permittivity Measurements", Eric J. Vanzura, Richard G. Geyer and Michael D. Janezic, Aug. 1993, National Institute of Standards and Technology Technical Note.

* cited by examiner

LUBRICANT DISPENSER WITH NOZZLE

RELATED APPLICATIONS

This application is a continuation-in-part of design patent application Ser. No. 29/301,659 filed Mar. 12, 2008 now U.S. Pat. No. Des. 589,807. This application is also a continuation-in-part of design patent application Ser. No. 29/301,660 filed Mar. 12, 2008 now U.S. Pat. No. Des. 589,808. This application is also a continuation-in-part of design patent application Ser. No. 29/301,661 filed Mar. 12, 2008 now U.S. Pat. No. Des. 589,809.

BACKGROUND OF THE INVENTION

The present invention relates generally to fluid dispensing, and more particularly to an improved fluid pour spout and a container utilizing such a spout.

Prior fluid dispensing containers are known. For instance, a common gas may be provided to hold a quantity of gasoline, and a nozzle may be removably coupled to the can to allow the contents to be transferred to a lawn and garden implement, for instance. Generally, in these fluid dispensing containers, the flow rate of the fluid is directly proportional to the angle at which the container is held relative to the nozzle. Such dependency on the angle at which the container is held may lead to fluid surges at the start of, or during, a pour, and may also lead to undesirable flow rates during the pour.

Other assistive devices have been developed, perhaps each with its own advantages. Indeed, twist flow control has been implemented on prior devices, thereby allowing control of the flow by a means other than the angle at which the fluid dispensing container is held relative to the nozzle. At least one drawback exists in prior twist flow control devices. The tip of the flow control nozzle moves relative to dispensing container. Thus, while limiting the attention required to the angle of the dispensing container, such nozzle may require added concentration regarding the positioning of the dispensing container with respect to the implement that is receiving the dispensed fluid.

Therefore, the art of fluid dispensing would benefit from an improved fluid dispensing nozzle that provides ease of flow control while minimizing the concentration required as to the positioning of the dispensing container.

SUMMARY OF THE INVENTION

The present invention provides an improved fluid dispensing nozzle that provides ease of flow control while minimizing the concentration required as to the positioning of the dispensing container.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
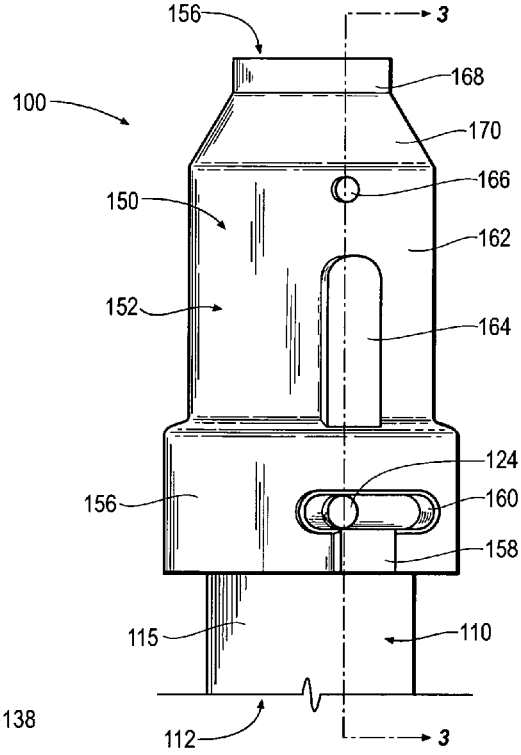
FIG. 1 is a front elevation view of a pour spout according to the present invention.

Turning now to the Figures, FIG. 1 provides a pour spout 100 according to the present invention. Also with reference to FIG. 2, the pour spout 100 generally includes a support tube 110, a plunger 130, and a flow control collar 150. The support tube 110 is preferably at least generally cylindrical in shape providing a fluid flow conduit from an entrance end 112 to an exit end 114, the fluid flow conduit being substantially circumscribed by a substantially cylindrical wall 115. The support tube 110 may be provided with a sealing flange 116 about its circumference to support a flange gasket 118, such as a rubber o-ring. The support tube 110 may also be provided with reinforcement ribs, either circumferential 120, longitudinal 122, or both. Extending generally radially outwardly from the support tube 110 is at least one, but preferably two, flow control guide posts 124. If a plurality of flow control guide posts 124 are used, it is preferable to space them evenly about the circumference of the support tube 110. Additionally, the support tube 110 is provided with at least one, but preferably two, plunger guide slots 126 formed at least partially through, but preferably completed through, the circumferential wall 115 of the support tube 110. The plunger guide slots 126 extend both longitudinally along the support tube 110 and radially about a longitudinal axis thereof.

Coaxially disposed within the support tube 110 is the plunger 130. While various arrangements are contemplated, the plunger 130 is inserted preferably from the exit end 114 of the support tube 110, so as to be rotatably and slidingly disposed within the fluid flow conduit of the support tube 110. The plunger 130 is generally preferably cylindrical having a generally cylindrical wall 132 extending from an open plunger entrance 134 at least partially towards a closed tip 136. The cylindrical wall 132 preferably has a diameter that is less than the diameter of the fluid flow conduit of the support tube 110 to allow relatively easy dry mobility of the plunger 130 within the support tube 110. Disposed on the plunger wall 132 is at least one, but preferably two, plunger guide posts 138. Generally, it is preferable to provide the same number of plunger guide posts 138 as the number of plunger guide slots 126 provided in the support tube 110, but fewer posts 138 than slots 126 may be provided. Further, the plunger wall 132 is provided with at least one, but preferably two fluid ports 140 situated between the open plunger entrance 134 and the closed tip 136. A plunger gasket 142, such as a rubber o-ring, may be provided, preferably situated between the at least one fluid port 140 and the closed tip 136.

Coaxially disposed over at least a portion of the support tube 110 is the flow control collar 150. The flow control collar 150 preferably generally comprises a stepped substantially cylindrical wall 152 extending between an open support end 154 and an open fluid exit 156. Nearest the open support end 154 is provided preferably a rear support flange 156 having the greatest diameter of any other portions of the wall 152. Extending from the open support end 154, preferably parallel to a longitudinal axis about which the wall 152 is formed, is at least one, but preferably two flow control guide channels 158. Preferably, the same number of guide channels 158 is provided as are provided flow control guide posts 124 on the support tube 110, although fewer guide posts 124 may be provided. The flow control guide channels 158 each intersect a flow control guide slot 160. The flow control guide slot 160 extends at least partially, but preferably completely through the rear support flange 156, extending radially for a predetermined flow control travel length. Thus, when the flow control collar 150 is placed upon the support tube 110, the flow control guide posts 124 may be directed through the flow control guide channels 158 and into the flow control guide slots 160. Once the flow control guide posts 124 are situated in the flow control guide slots 160, the flow control collar 150 is allowed to rotate back and forth about the support post 110 for the flow control travel length.

Extending from the rear support flange 156 of the flow control collar 150, away from the open support end 154, is a medial collar portion 162 of the generally cylindrical wall 152 having preferably a smaller diameter than the rear support flange 156. Extending at least partially along and at least partially through the medial collar portion 162 of the wall 152 is at least one, but preferably two longitudinal plunger guide channels 164. It is preferred to provide the same number of plunger guide channels 164 as are provided plunger guide posts 138 on the plunger 130; however, fewer posts 138 may be provided. The plunger guide channels 164 are adapted to receive the plunger guide posts 138 that extend from the plunger 130. Also extending from the wall 152 of the collar 150, preferably from the medial portion 162, is at least one, but preferably two nozzle locking posts 166. Extending from the medial collar portion 162 of the flow control collar 150, towards the open fluid exit 156, is a flow control nozzle 168 of the generally cylindrical wall 152 having preferably a smaller diameter than the medial collar portion 162, which may be coupled to the medial collar portion 162 by a chamfered transition section 170 of the wall 152.

Figure 2:
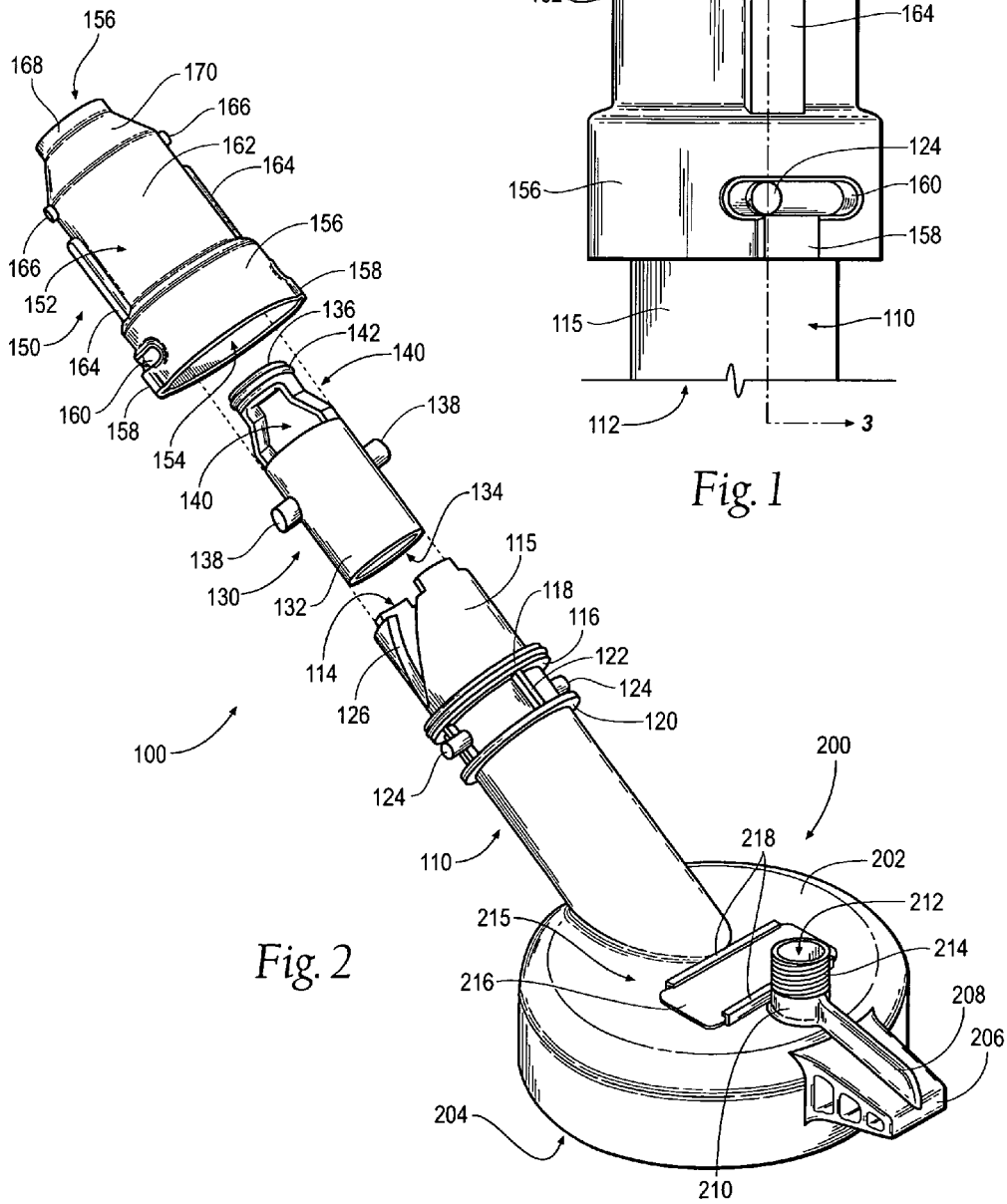
FIG. 2 is a perspective partial exploded view of a container lid according to the present invention, incorporating the pour spout of FIG. 1.
Figure 8:
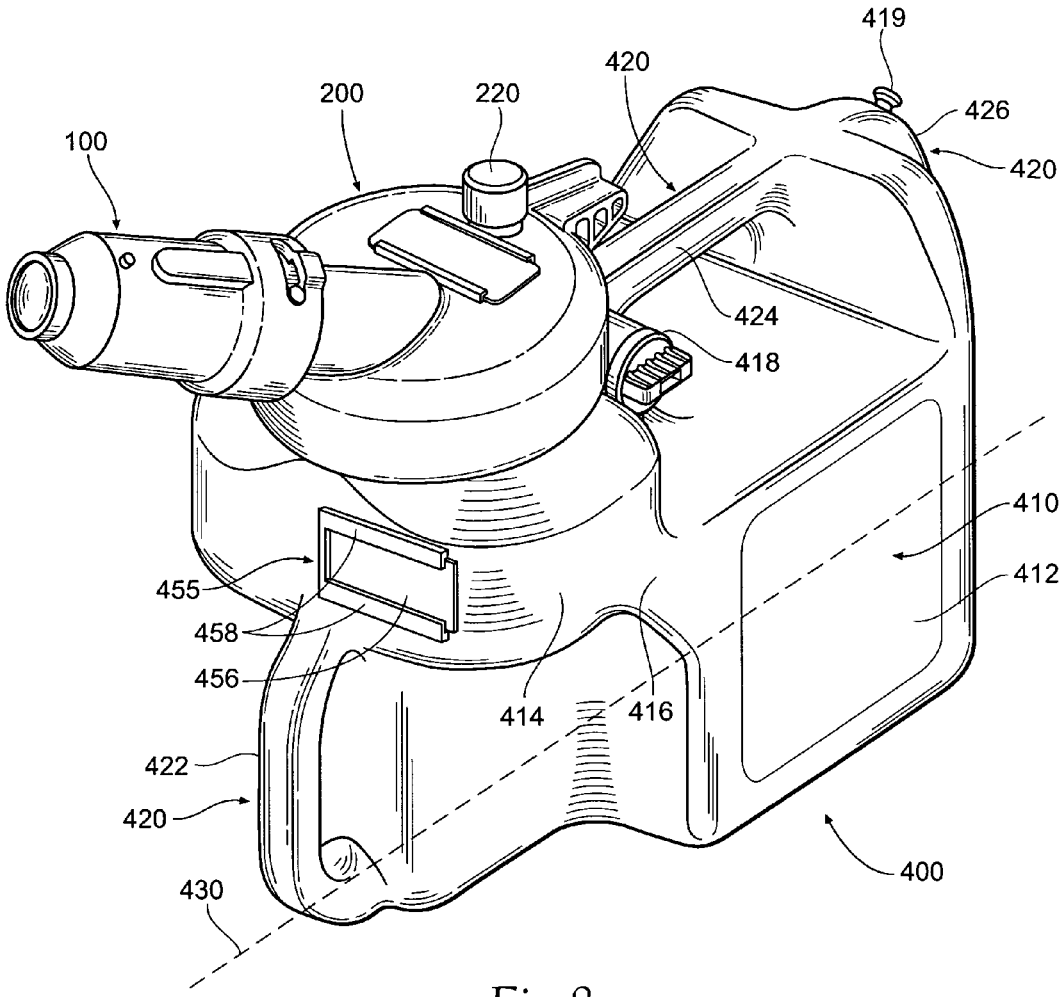
FIG. 8 is a perspective view of the lid of FIG. 2 coupled to a first embodiment of a fluid container according to the present invention.

The pour spout 100 is generally adapted to be used in conjunction with a fluid container. While the spout 100 could extend directly from a fluid container, such as by forming the support tube 110 integrally with such container, it may be preferable to provide a spout that is removably coupled to such container. FIG. 2 displays a lid 200 adapted to be removably coupled to a fluid container, including the support tube 110 of the pour spout 100 formed integrally with and extending from a top surface 202 thereof. The lid 200 includes a container coupling means 204, such as a threaded aperture to correspond to a threaded collar on a fluid container. Alternatively, the container coupling means 204 may include a positive lock circumferential friction fit, thereby allowing the lid 200 to be pushed onto a mating surface of a container. The lid 200 also preferably includes a lid tab 206 to assist in handling the lid 200 and securing the lid 200 to, and removing the lid 200, from a container. The lid tab 206 is preferably reinforced, such as by way of a reinforcement rib 208 provided along at least a portion of the length of the tab 206, as shown. The lid tab 206 extends preferably radially outwardly from the lid 200, as shown, and more preferably in a direction that is different than the direction from which the spout 100 extends. The lid 200 may also be provided with a vent 210, providing an aperture 212 extending through the lid 200. The vent 210 may include a plurality of threads 214, or other engaging means, to mate with and secure a cap 220, as can be seen in FIG. 8. In addition, the lid 200 may be provided with a content indicator 215, such as a tag 216 that may be slidably disposed in a pair of substantially parallel tag rails 218 that may be formed integrally with the top surface 202 of the lid 200.

Figure 3:
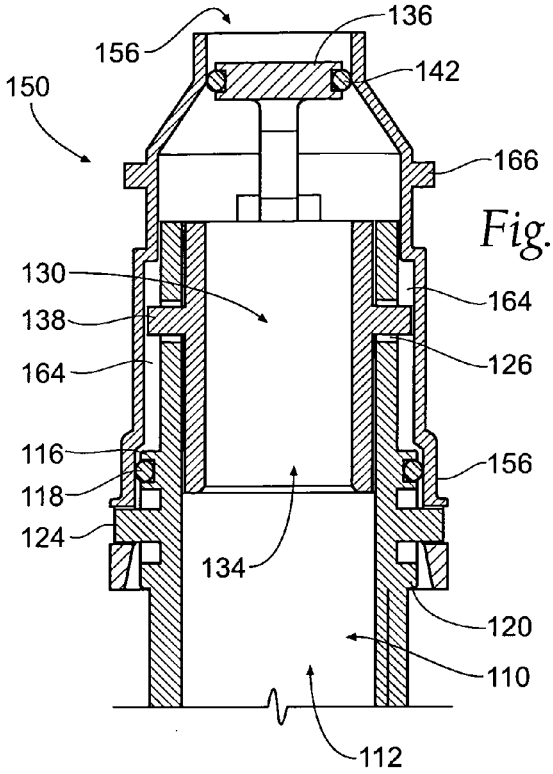
FIG. 3 is a left elevation cross-section view taken along line 3-3 in FIG. 1.
Figure 4:
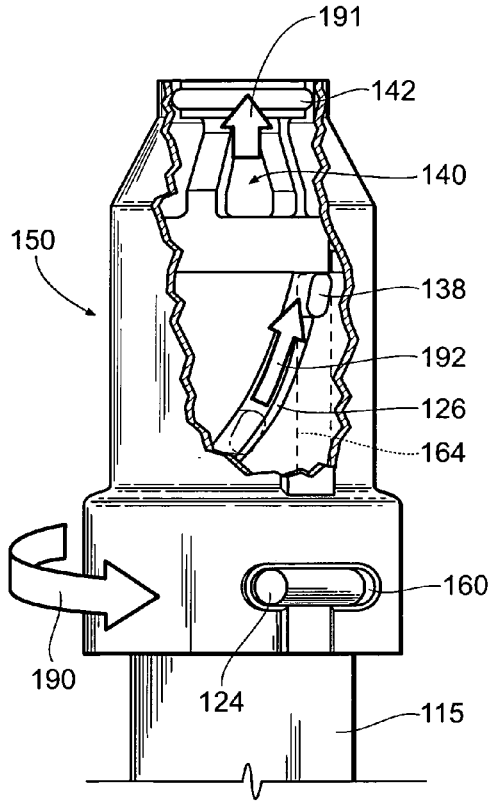
FIG. 4 is a front elevation partial cut-away view of the pour spout of FIG. 1.
Figure 5:
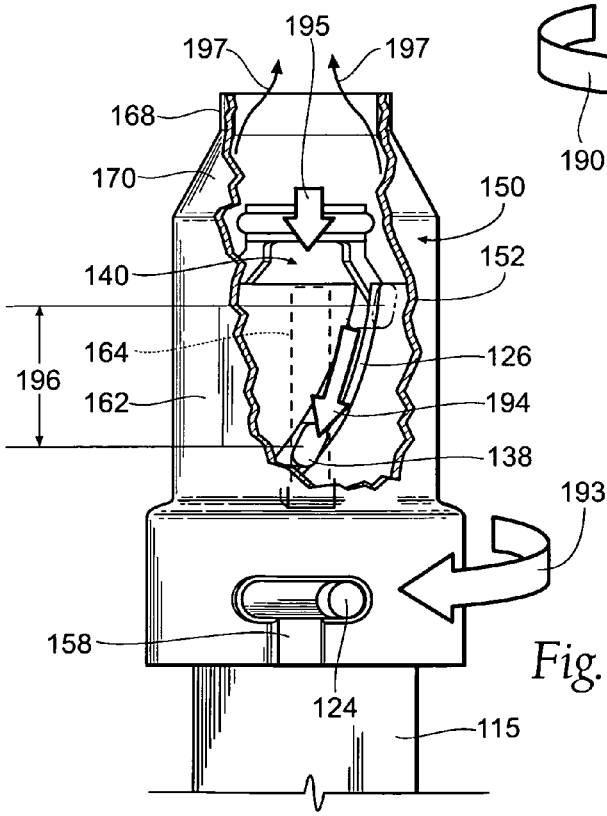
FIG. 5 is a front elevation partial cut-away view of the pour spout of FIG. 1.

Turning now to FIG. 3, FIG. 4 and FIG. 5, the operation of a pour spout 100 according to the present invention is described. FIG. 3 is a cross section view taken along line 3-3 of FIG. 1. As can be seen, the plunger 130 has been slidingly engaged with the support tube 110, the plunger guide posts 138 having been inserted into the plunger guide slots 126 formed in the support tube wall 115. Furthermore, the flow control collar 150 has been positioned over the support tube 110, the flow control guide posts 124 having been inserted through the flow control guide channels 158 and into the flow control guide slots 160, and the plunger guide channels 164 straddling the plunger guide posts 138. The flange gasket 118 cooperates with the rear support flange 156 in a sliding engagement, and the plunger gasket 142 cooperates with the flow control nozzle 168, also in a sliding engagement. FIG. 4 shows the pour spout 100 in a closed position, with the flow control collar 150 having been rotated in a first direction 190. When the flow control collar 150 is rotated in the first direction 190, the plunger guide channels 164, which are straddling the plunger guide posts 138, force the plunger guide posts 138 to travel along the plunger guide slots 126 in a first plunger guide direction 192, which is at least substantially parallel to the plunger guide slots 126. In this way, the plunger 130 is urged in a plunger closing direction 191, thereby causing the plunger gasket 142 to engage the flow control nozzle 168, stopping the flow of fluid out of the fluid exit end 156 of the flow control collar 150. FIG. 5 shows the pour spout 100 in an open position, with the flow control collar 150 having been rotated in a second direction 193. When the flow control collar 150 is rotated in the second direction 193, the plunger guide channels 164, which are straddling the plunger guide posts 138, force the plunger guide posts 138 to travel along the plunger guide slots 126 in a second plunger guide direction 194, which is at least substantially parallel to the plunger guide slots 126. In this way, the plunger 130 is urged in a plunger opening direction 195 for a desired displacement distance 196, thereby causing the plunger gasket 142 to disengage from the flow control nozzle 168, and allowing fluid to flow out of the fluid exit end 156 of the flow control collar 150 in a fluid flow direction 197. The displacement distance 196 may be adjusted by rotating the flow control collar 150 in either the first direction 190 or the second direction 193. In this embodiment, the greater the displacement distance 196, the faster the fluid will flow from the nozzle 168. Thus, fluid is allowed to enter the spout 100 at the entrance end 112 of the support tube 110, through the plunger entrance 134, through the fluid ports 140 of the plunger 130, between the plunger gasket 142 and the chamfered transition section 170 of the flow control collar wall 152 and out of the fluid exit end 156 of the flow control nozzle 168.

Figure 6:
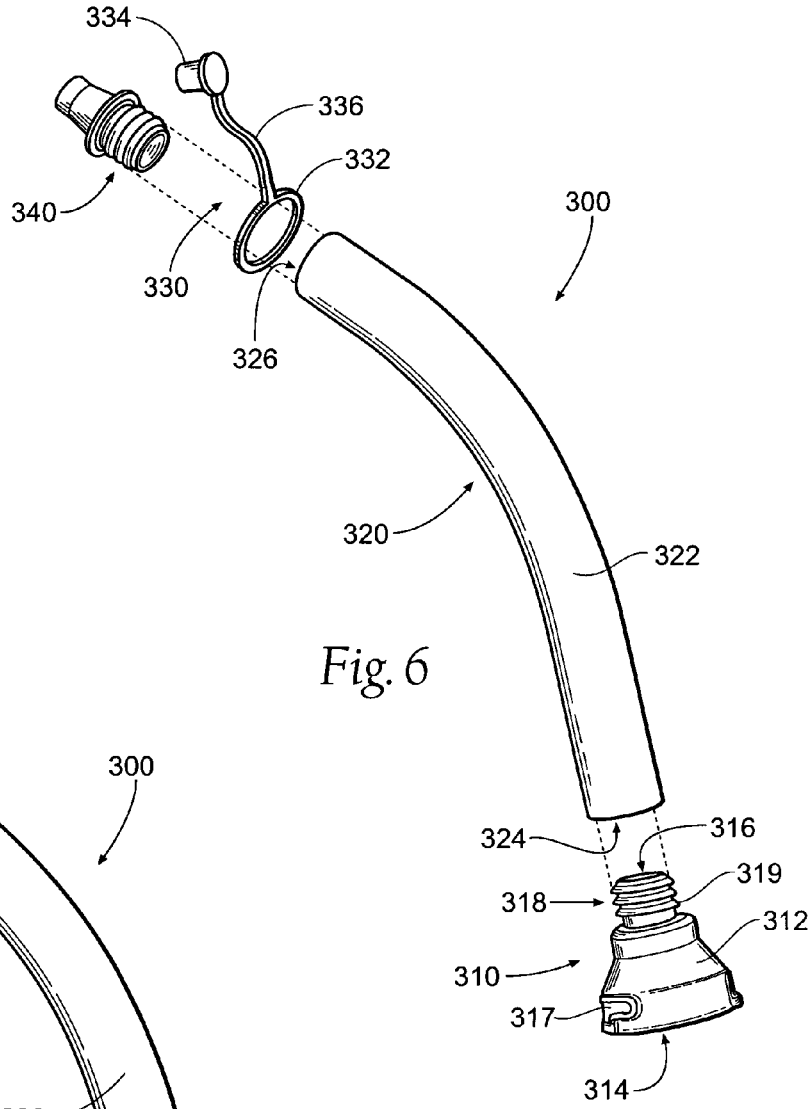
FIG. 6 is an exploded perspective view of an embodiment of a pour spout extension according to the present invention.
Figure 7:
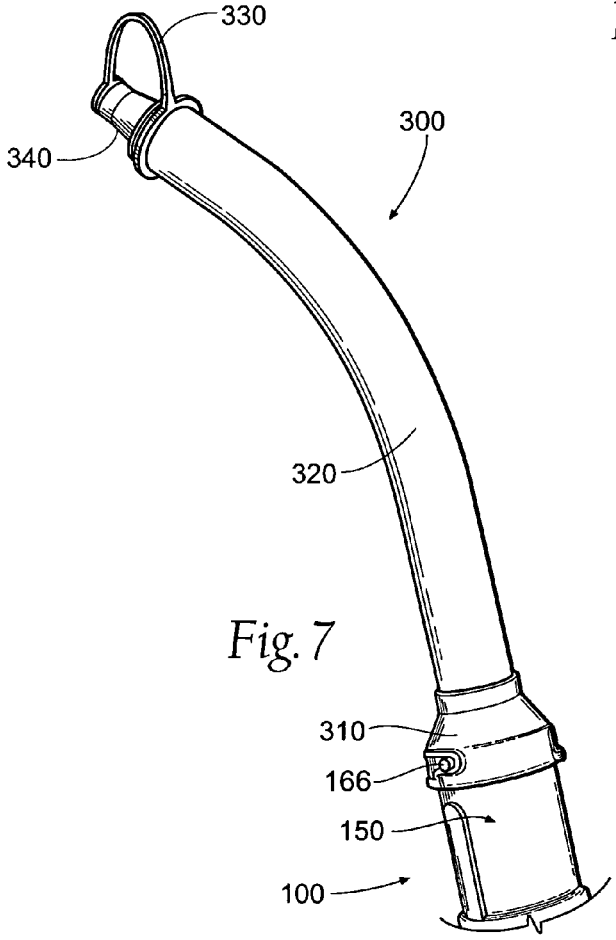
FIG. 7 is a perspective view of the pour spout extension of FIG. 6 coupled to the pour spout of FIG. 1.

Turning now to FIG. 6 and FIG. 7, it may be desirable to provide an extension nozzle so as to allow fluid transfer from a fluid storage or transfer container to a receiving container with further control, or perhaps if the receiving container has a smaller receiving aperture than the fluid exit end 156 of the flow control collar 150 of the pour spout 100. Provided is an embodiment of an extension nozzle 300 according to the present invention. The extension nozzle 300 preferably generally comprises a nozzle base 310, a nozzle tube 320, a nozzle cap 330 and a nozzle tip 340. The nozzle base 310 comprises a preferably reducing diameter body 312 extending between an open nozzle base end 314 and an open tube interface 316. The body 312 of the nozzle base 310 preferably includes at least one, but preferably two nozzle support slots 317. There are preferably provided the same number of nozzle support slots 317 as the number of nozzle support posts 166 provided on the pour spout 100, although fewer support posts 166 may be provided. While the nozzle support slots 317 may be formed to provide a relatively positive friction lock against rotation of nozzle base 310 when the slots 317 engage the nozzle support posts 166, the slots 317 may also be formed to allow rotation of the flow control collar 150 while maintaining the extension nozzle 300 in a relatively stationary position. Thus, control of fluid flow by rotating the flow control collar 150 may be achieved even when both the extension nozzle 300 and a fluid container to which the spout 100 is coupled are maintained in static positions. The nozzle base 310 also preferably includes a tube engaging stub 318, which may be provided with a plurality of circumferential ridges 319 to aid in maintaining a fluid tight seal between the tube 320 and the nozzle base 310.

The extension nozzle tube 320 includes a preferably substantially cylindrical wall 322 surrounding a throughbore (not shown) extending between an open first end 324 and an open second end 326. The open first end 324 preferably cooperates with the tube engaging stub 318 on the nozzle base 310. The nozzle cap 330 generally includes a support ring 332, a nozzle plug 334 and a strap 336 extending therebetween. The support ring 332 may be adapted to be frictionally engageable about a circumference of the nozzle tube wall 322. The nozzle tip 340 is adapted to be inserted into the open second end 326 of the nozzle tube wall 322. Thus, when the extension nozzle 300 is assembled, a fluid flow conduit is formed from the open nozzle base end 312, through the open tube interface 316, the open first end 324 of the tube wall 322, the open second end 326 of the tube wall 322, and through the nozzle tip 340. The nozzle plug 334 is adapted to be inserted into the nozzle tip 340, as shown in FIG. 7, to prevent the flow of fluid out of the nozzle tip 340. FIG. 7 depicts the extension nozzle of FIG. 6 fitted onto a pour spout 100 according to the present invention, the nozzle support posts 166 having been situated in the nozzle guide slots 317.

Figure 12:
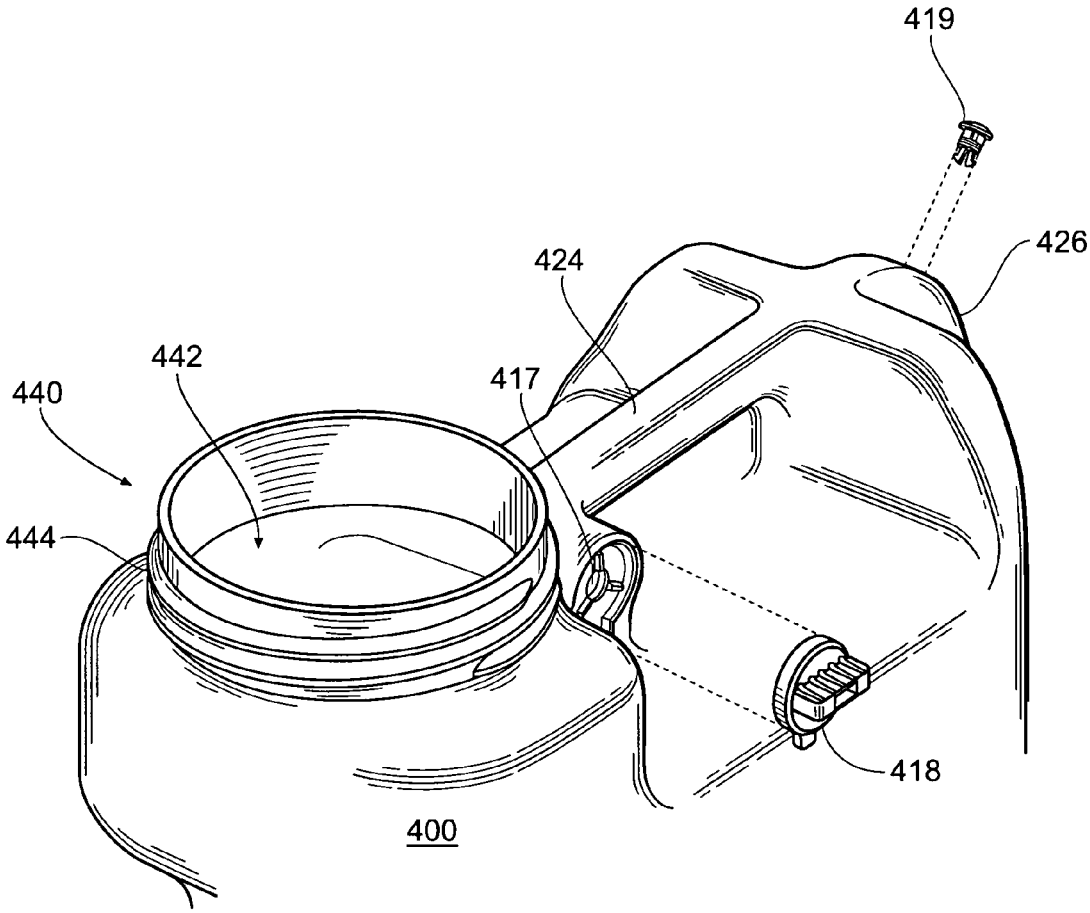
FIG. 12 is a partial exploded perspective view of a top portion of the fluid container of FIG. 9.

Turning now to FIG. 8, a preferred container 400 for use in dispensing a fluid is shown. The container 400 includes a fluid reservoir 410 and at least one, but preferably a plurality of handles 420. While any suitable reservoir may be used, the fluid reservoir 410 is formed with preferably a base compartment 412 and a surge compartment 414, the base compartment 412 and surge compartment 414 being in fluid communication with each other, at least in part, through a narrowed neck 416. Coupled, preferably removably coupled, to the container 400 is a lid 200 and a pour spout 100 according to the present invention. When the container 400 is lifted and tipped to pour liquid contained therein out of the pour spout 100, the narrowed neck 416 of the reservoir 410 may prevent a deluge of fluid from rushing towards the spout 100, thereby giving more control to a user of the container 400. In fluid communication with the fluid reservoir 410 is at least one vent aperture 417, which may be selectively opened or closed, such as by use of a toggle cap 418, see FIG. 12. One or more additional vent holes (not shown) may be provided, perhaps adapted to receive a vent hole plug 419. Regarding the preferable plurality of handles 420, the container 400 is provided with a front handle 422, a top handle 424 and a rear handle 426, any or all of which may be located along a lateral midline 430 of the container 400. While the handles 420 may be formed from a solid material, it may be preferable to provide the container with hollow handles 420, thereby providing increased container fluid capacity. In addition, the container 400 may be provided with a content indicator 455, such as a tag 456 that may be slidably disposed in a pair of substantially parallel tag rails 458 that may be formed integrally with the container 400.

Figure 9:
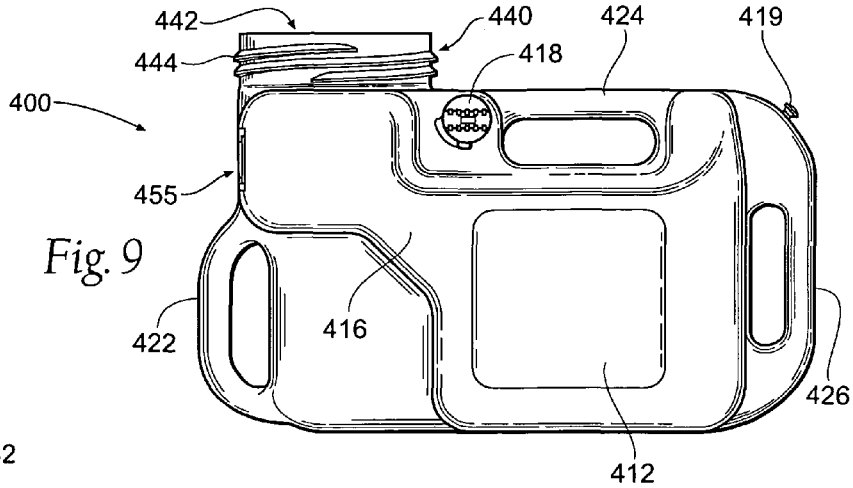
FIG. 9 is a right side elevation view of the fluid container of FIG. 8.

Referring now to FIG. 9, the container 400 of FIG. 8 is shown as having the lid 200 and nozzle 100 removed from the container 400. Like reference numerals in FIG. 9, FIG. 10 and FIG. 11 refer to like structures. If a nozzle support tube 110 is not integrally formed with a container 400, the container is preferably provided with a nozzle interface, such as a nozzle mounting flange 440. The nozzle mounting flange 440 includes a fluid aperture 442 in fluid communication with the fluid reservoir 410, preferably with the surge compartment 414. The flange 440 is also preferably provided with threads 444, which may be mateable with threads provided on the container coupling means 204 of a lid 200 according to the present invention.

Figure 10:
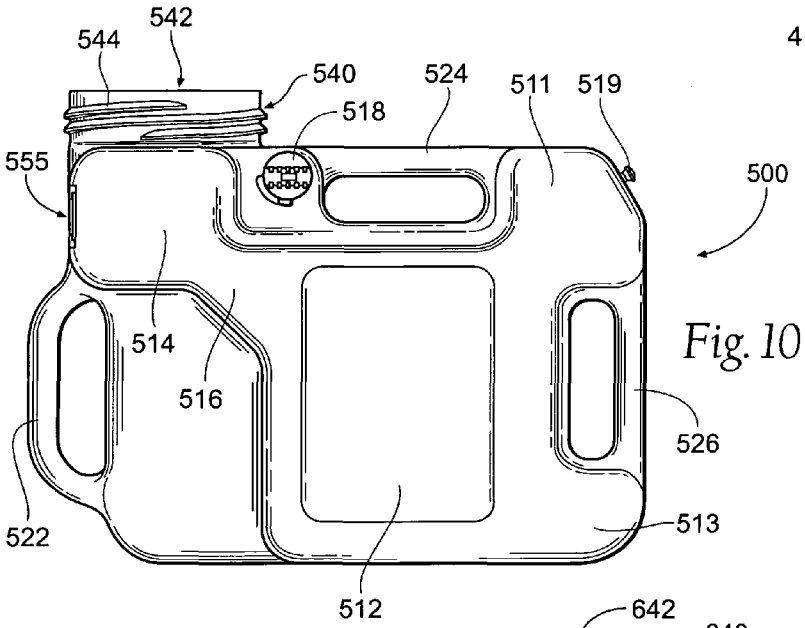
FIG. 10 is a right side elevation view of a second embodiment of a fluid container according to the present invention.
Figure 11:
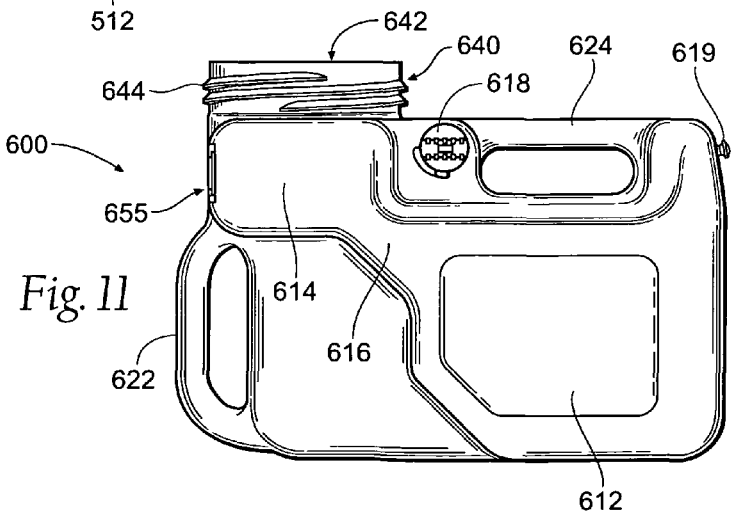
FIG. 11 is a right side elevation view of a third embodiment of a fluid container according to the present invention.

Referring to FIG. 10, a second embodiment 500 of a container according to the present invention is provided. Similar in construction to the first embodiment 400, the second embodiment 500 includes a top rear fluid compartment 511 situated above and over the rear handle 526 and a bottom rear fluid compartment 513 situated below and under the rear handle 526. Additionally, as can be seen, the proportions of the second embodiment 500 are different than those of the first. Turning now to FIG. 11, a third embodiment 600 of a container according to the present invention is provided. Also similar in construction to the first embodiment 400, the third embodiment 600 does not include a rear handle.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

We claim:

1. A pour spout for use in the transfer of fluids, said pour spout comprising:

a support tube;

a plunger slidably and rotatably disposed at least partially within said support tube; and a flow control collar rotatably disposed at least partially on said support tube, wherein rotation of said flow control collar about said support tube causes said plunger to slide at least partially within said support tube;

said support tube comprising a generally cylindrical support wall surrounding a support fluid flow conduit and extending between an entrance end and an exit end;

said flow control collar comprising:

a collar wall extending between an open support end and an open fluid exit, said collar wall being a stepped substantially cylindrical wall;

said flow control collar comprising:

a rear support flange portion;

a medial collar portion; and a flow control nozzle, said rear support flange extending from said open support end to a first end of said medial collar portion and said flow control nozzle extending from a second end of said medial collar portion to said open fluid exit; said rear support flange portion further comprising:

at least one flow control guide channel extending from said open support end; and at least one flow control guide slot extending radially at least partially around said rear support flange and intersecting at least one of said at least one flow control guide channel.

2. A pour spout according to claim 1, said pour spout further comprising:

a plurality N of flow control guide posts extending generally radially outward from said support wall of said support tube;

a plurality N of said flow control guide channels; and a plurality N of said flow control guide slots, said plurality of flow control guide posts being insertable through said plurality of said flow control guide channels into said plurality of flow control guide slots.

3. A pour spout for use in the transfer of fluids, said pour spout comprising:

a support tube;

a plunger slidably and rotatably disposed at least partially within said support tube; and a flow control collar rotatably disposed at least partially on said support tube, wherein rotation of said flow control collar about said support tube causes said plunger to slide at least partially within said support tube;

said support tube comprising a generally cylindrical support wall surrounding a support fluid flow conduit and extending between an entrance end and an exit end;

said flow control collar comprising:

a collar wall extending between an open support end and an open fluid exit, said collar wall being a stepped substantially cylindrical wall;

said flow control collar comprising:

a rear support flange portion;

a medial collar portion; and a flow control nozzle, said rear support flange extending from said open support end to a first end of said medial collar portion and said flow control nozzle extending from a second end of said medial collar portion to said open fluid exit;

said pour spout further comprising at least one nozzle locking post extending generally radially outward from said collar wall.

4. A pour spout according to claim 3, said at least one nozzle locking post extending from said medial collar portion.

* * * * *